United States Patent [19]

Rueggeberg

[11] 4,185,182

[45] Jan. 22, 1980

[54] MICROWAVE OVEN APPARATUS

[75] Inventor: Werner Rueggeberg, Lancaster, Pa.

[73] Assignee: Armstrong Cork Company, Lancaster, Pa.

[21] Appl. No.: 921,467

[22] Filed: Jul. 3, 1978

[51] Int. Cl.[2] ..... H05B 9/06

[52] U.S. Cl. ..... 219/10.55 F

[58] Field of Search ..... 219/10.55 F, 10.55 D, 219/10.55 R

[56] References Cited

U.S. PATENT DOCUMENTS

| | | | |
|---|---|---|---|
| 2,618,735 | 11/1952 | Hall | 219/10.55 F |
| 2,920,174 | 1/1960 | Haagensen | 219/10.55 F |
| 3,189,722 | 6/1965 | Fritz | 219/10.55 F |
| 3,364,332 | 1/1968 | Reftmark | 219/10.55 F |
| 3,436,507 | 4/1969 | Puschner | 219/10.55 F |
| 3,474,211 | 10/1969 | Soulier | 219/10.55 F |
| 3,517,152 | 6/1970 | Gialobbe | 219/10.55 F |
| 3,526,737 | 9/1970 | Black | 219/10.55 F |
| 4,054,768 | 10/1977 | White et al. | 219/10.55 D |
| 4,144,436 | 3/1979 | Hauck | 219/10.55 D |

*Primary Examiner*—Grimley Arthur T.

[57] ABSTRACT

A microwave oven is provided having a field stirring and shifting device for use at high power levels. A circular plate having a set of parallel strips affixed to its surface is mounted in a recessed position in one wall of the heating chamber of a microwave oven. The plate is rotated to periodically affect the microwave heating field distribution in the chamber and to provide more uniform heating of objects in the chamber.

3 Claims, 2 Drawing Figures

MICROWAVE OVEN APPARATUS

BACKGROUND OF THE INVENTION

The present invention relates generally to microwave ovens and, more particularly, to devices for field stirring and shifting to provide uniform heating in microwave ovens.

In conventional microwave ovens, reflection of microwave energy by the walls of the oven heating chamber leads to the establishment of standing wave patterns or energy modes in the oven. Such patterns comprise locations of high and low electric field intensities which roughly correspond to locations of hot and cold spots in the heating field within the oven. This nonuniformity in the oven heating field results in undesirable nonuniform heating treatment of materials in the oven.

In order to improve the uniformity of heating effects in the oven it has generally been the practice to employ fixed or moving elements which allow a number of energy modes to be excited within the heating chamber of the oven. By adding together the electric fields of the different modes, a substantially more uniform heating field is obtained. A further improvement is to provide a field or mode stirring device, usually a rotating element having fan-type blades. The blades of the field stirring device reflect incident microwave energy as they rotate and so provide periodically shifting electric field patterns in the oven. The shifting heating patterns which result integrate timewise to provide more uniform heating effects in the oven heating chamber. However, the foregoing described devices do not entirely eliminate the problem of non-uniform heating effects in microwave ovens.

Another approach to providing uniform heating effects has been to employ rotating grids which affect the polorization and distribution of microwave energy present in the heating chambers of microwave ovens, periodically shifting the heating field pattern in the chamber and/or stirring up the energy mode patterns in the oven. However, these devices as previously disclosed, i.e. U.S. Pat. No. 2,618,735 and U.S. Pat. No. 3,189,722, although effective, have been bulky and have been subject to arcing and insulation failure at high power levels.

SUMMARY OF THE INVENTION

It is, therefore, a principle object of the present invention to provide a microwave oven which furnishes uniform heating effects throughout its heating chamber.

It is a further object of the present invention to provide a microwave oven wherein changing energy mode patterns and periodically shifting microwave energy field patterns furnish a uniform integrated overall heating effect throughout the oven heating chamber.

It is another object of the present invention to provide a microwave oven having a field stirring and/or shifting means which may operate at high power levels without arcing or insulation failure, and which microwave oven is efficient, effective, durable, and otherwise well adapted to the purposes for which the same is intended.

Accordingly, the present invention provides a microwave oven having a heating chamber defined by a set of parallel conductive walls, a microwave energy source coupled to the heating chamber, a plate adapted to be rotated having strips affixed to its surface, and a motor means for rotating the plate. The plate is a conductive disc. The strips are conductive planks affixed to the surface of the plate. The plate and strips are mounted in a recessed position in one wall of the heating chamber of the oven so that the edges of the strips are flush with the wall of the chamber in which the plate and strips are mounted. The strips are linear and parallel except for one circular strip affixed to the outside periphery of the plate. This circular strip, together with the housing around the plate and as end ring, form an annular radiation trap. In operation, the plate and strips are rotated causing field stirring and/or shifting in the heating chamber and providing a uniform heating effect. The radiation trap prevents microwave radiation from escaping around the edges of the plate out of the heating chamber.

DESCRIPTION OF THE PREFERRED EMBODIMENT

Figure 1:
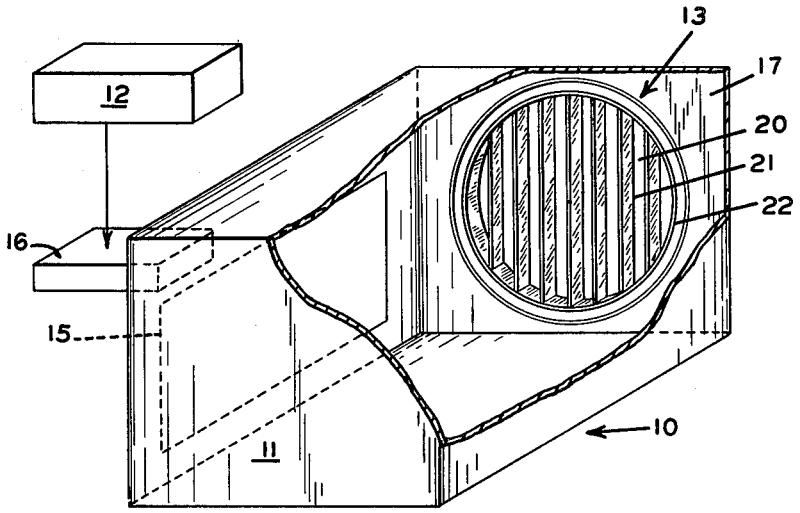
FIG. 1 shows a cut away perspective view of the present invention.

Referring now to the drawings wherein like reference characters refer to like or corresponding parts throughout the different views, FIG. 1 shows an overall view of the microwave oven 10 of the present invention. Oven 10 includes heating chamber 11, microwave energy source 12, field shifting device 13, and motor means 40 (not shown in FIG. 1). Chamber 11 is a prism-shaped cavity defined by sets of parallel conductive walls separated by distances large as compared to the wavelength of the microwave energy intended to be used in the chamber. A door 15 is provided in one wall of chamber 11 to allow materials to be treated to be placed in and retrieved from the chamber. Microwave energy source 12 may be a magnetron, although any conventional microwave tube could be used. Energy source 12 is preferably constructed to operate at 2,540 megahertz although any suitable microwave frequency may be used. Energy source 12 is coupled to chamber 11 through waveguide 16. Field shifting device 13 is recessed in one wall 17 of the chamber 11.

Figure 2:
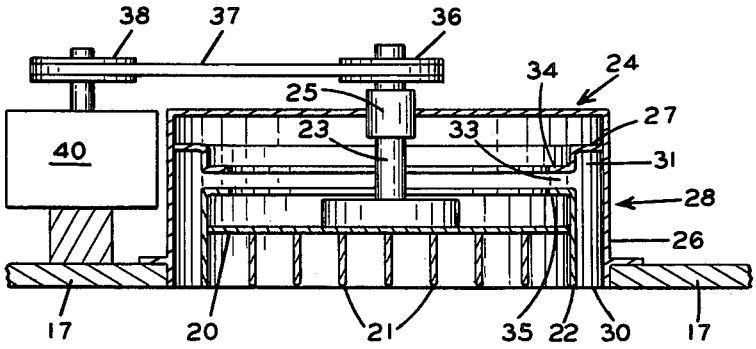
FIG. 2 shows a cross-sectional view of the field stirring and/or shifting device of the present invention installed in the wall of a microwave oven.

Referring now in particular to FIG. 2, field shifting and stirring device 13 includes plate 20, linear strips 21, circular strip 22, and shaft 23. The field stirring device 13 is mounted in housing 24 supported by bearing 25 so as to leave the edges of strips 21 and 22 flush with the wall 17. Plate 20 is a flat conductive disc large enough to cover a substantial part of the wall of the chamber 11 in which it is mounted. Strips 21 are thin conductive planks which run linear and parallel to one another along the surface of plate 20 to which they are affixed continuously along their length. Strips 21 project out perpendicularly from plate 20 and preferably extend outward a distance equal to $\frac{1}{2}$ the TEM mode wavelength of the microwave energy supplied to the chamber 11. The TEM mode wavelength is approximately equal to the free space wavelength of the microwave energy in the present case. If 2,540 megahertz radiation is used, the strips 21 would therefore project outward from the plate approximately 2.41 inches. The strips 21 are preferably spaced apart a distance such that the distance the strips project outward from the plate 20 is made equal to $\frac{1}{4}$ TEl mode wavelength of the microwave energy supplied to the chamber 11. The distance the strips 21 should be spaced apart may be determined by solving the following formula:

$$\lambda^2_1 = \frac{(2\pi)^2}{\left(\frac{2\pi f}{c}\right)^2 - \left(\frac{\pi}{y_o}\right)^2}$$

where $\lambda_1$=TEl mode (Parallel Plane) microwave wavelength, f=microwave frequency, c=speed of light, and $y_o$=air spaced apart distance. If 2,450 megahertz radiation is used, strips 21 should be air spaced apart approximately 2.78 inches. Strip 22 is a thin conductive circular plank which is affixed to the periphery of plate 20. Strip 22 projects perpendicularly outward from plate 20 a distance equal to the distance strips 21 project outward from the plate, namely, ½ TEM mode wavelength distance.

Strip 22 also projects outward in back of the plate 20. Strip 22, housing wall 26, and ring 27 comprise an annular radiation trap 28 which blocks radiation from propagating around and behind plate 20. Strip 22 and wall 26 form an annular channel 30 which is preferably as radially narrow as possible and should be an integral, odd, multiple of ¼ of the free space wavelength of the microwave energy deep. End ring 27 is an S shaped ring attached to wall 26 so that a small channel 31, an odd, integral multiple of ¼ free space wavelength deep, coextensive with channel 30, is formed. Ring 27 and strip 22 also form a third channel 33 between their respective extensions 34 and 35. Channel 33 is preferably narrow and should be an integral, odd, multiple of ¼ free space wavelength radially long. Pulley 36 is secured to the end of shaft 23 on the other side of housing 24 from where the shaft is secured to the plate 20. Belt 37 runs around pulley 36 and pulley 38 on motor means 40. Motor means 40 may be any motor such as an electric motor suitable for driving shaft 23 and plate 20 in rotation. Plate 20 is preferably rotated at 1–3 r.p.m. during operation.

In operation the microwave energy is supplied to chamber 11 by energy source 12 through waveguide 16. This energy propagates in chamber 11 and establishes a microwave energy field pattern or energy mode pattern in the chamber. This field pattern interacts with the device 13 and particularly with the strips 21 and the surface of the plate 20. As the plate 20 and strips 21 rotate, besides stirring and creating complex energy modes in the chamber 11, the strips act as parallel plane wave guides having highly directional wave impedance properties. These variable wave impedance properties are due to the different modes of propagation which are forced to be excited during operation of the unit. Electric fields perpendicularly directed to the planes of the strips 21 view low wave impedance because of the properties of a TEM guide, ½ wavelength in depth. However, electric fields parallel directed to the planes of the strips 21 view a high wave impedance due to the properties of a TEl guide, ¼ wavelength in depth. As the plate 20 and strips 21 are rotated, the impedance properties of the plate and strips are periodically changed, forcing periodic changes in the field, mode, and heating effect patterns in the chamber 11. The nature of the dimensions of the plate 20 and strips 21 are such that the field, mode, and heating effect patterns are shifted by ¼ wavelength in the chamber during rotation. Therefore, points of heating effect maximum are periodically shifted to points of heating effect minimum and vice-versa, leading to a uniform overall integrated heating field effect in the chamber 11. The annular radiation trap 28 prevents microwave energy from escaping around the edges of the plate 20 by creating a high reflection environment therearound by use of properly cooperating resonant channels.

What is claimed is:

1. A microwave oven, comprising:

(a) a conductive wall structure defining a heating chamber adapted to be excited by a microwave energy source;

(b) a microwave energy source coupled to said chamber;

(c) a circular conductive plate having a plurality of linear, parallel, conductive strips affixed to one surface and having a circular conductive strip affixed to its periphery, said plate mounted in a recessed position in one wall of said chamber so that said linear strips face the interior of said chamber and so that the edges of said strips lie flush with the wall of said chamber in which said plate is mounted, said plate adapted to be rotated along its transverse axis by a motor means;

(d) motor means for rotating said plate; and (e) said microwave energy source and said plate cooperating for providing a microwave heating field in said chamber and for affecting said energy field by the plate rotation so uniform heating may be provided in said chamber.

2. The oven of claim 1 wherein said strips project outward from the surface of said plate ½ TEM mode wavelength distance and said strips are spaced apart from one another so that the distance which the strips project outward from the plate is equal to ¼ TEl mode wavelength distance.

3. The oven of claim 2, further including means for blocking microwave radiation, comprising an annular radiation trap disposed around the periphery of said plate.

* * * * *